US006790053B2

(12) United States Patent
Lin et al.

(10) Patent No.: US 6,790,053 B2
(45) Date of Patent: Sep. 14, 2004

(54) ELECTRICAL CONNECTOR WITH MOLDED PLASTIC HOUSING

(75) Inventors: Hai Bin Lin, Singapore (SG); Ser Kiat Toh, Singapore (SG); Swee Hong Ong, Singapore (SG)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/755,489

(22) Filed: Jan. 5, 2001

(65) Prior Publication Data

US 2001/0021597 A1 Sep. 13, 2001

(30) Foreign Application Priority Data

Jan. 25, 2000 (SG) ..... 200000431-7

(51) Int. Cl.[7] ..... H01R 12/00
(52) U.S. Cl. ..... 439/79; 439/540.1
(58) Field of Search ..... 439/374, 248, 439/357, 79, 540.1

(56) References Cited

U.S. PATENT DOCUMENTS

| | | | | |
|---|---|---|---|---|
| 4,978,313 A | | 12/1990 | Kameyama et al. | 439/248 |
| 4,993,965 A | * | 2/1991 | Eck | 439/374 |
| 5,178,557 A | | 1/1993 | Hashiguchi | 439/357 |
| 5,238,413 A | | 8/1993 | McCaffrey et al. | 439/79 |
| 5,281,165 A | | 1/1994 | McCleerey et al. | 439/510 |
| 5,354,214 A | | 10/1994 | Aso et al. | 439/492 |
| 5,356,300 A | | 10/1994 | Costello et al. | 439/101 |
| 5,547,398 A | | 8/1996 | Ichikawa et al. | 439/607 |
| 5,549,480 A | | 8/1996 | Cheng | 439/79 |
| 5,562,507 A | | 10/1996 | Kan | 439/676 |
| 5,584,709 A | | 12/1996 | Kiat | 439/79 |
| 5,637,019 A | * | 6/1997 | Crane, Jr. et al. | 439/677 |
| 5,727,957 A | | 3/1998 | Hashimoto et al. | 439/79 |
| 5,782,644 A | | 7/1998 | Kiat | 439/79 |
| 5,816,842 A | * | 10/1998 | Thantrakul et al. | 439/374 |
| 5,823,799 A | | 10/1998 | Tor et al. | 439/79 |
| 5,860,815 A | | 1/1999 | Feldman et al. | 439/79 |
| 5,865,651 A | | 2/1999 | Dague et al. | 439/680 |
| 5,897,386 A | | 4/1999 | Baxter et al. | 439/79 |
| 6,168,453 B1 | * | 1/2001 | Kuo | 439/357 |
| 6,217,347 B1 | * | 4/2001 | Schell et al. | 439/79 |

FOREIGN PATENT DOCUMENTS

| | | | |
|---|---|---|---|
| EP | 0 583 045 A3 | 2/1994 | H01R/9/07 |
| WO | WO 98/07215 | 2/1998 | H01R/9/09 |

OTHER PUBLICATIONS

Search & Examination Report.

* cited by examiner

*Primary Examiner*—Cary Paumen
*Assistant Examiner*—Edwin A. Leon
(74) *Attorney, Agent, or Firm*—Robert J. Zeitler

(57) ABSTRACT

An electrical connector includes a molded plastic housing having an elongated body portion defining a front mating face and a rear terminating face of the connector. A plurality of terminal-receiving passages are defined by walls extending between the mating and terminating faces. The walls are of generally uniform thickness between the faces to provide an even flow pattern for the plastic material of which the housing is molded. A plurality of conductive terminals are mounted in the terminal-receiving passages.

6 Claims, 3 Drawing Sheets

ELECTRICAL CONNECTOR WITH MOLDED PLASTIC HOUSING

FIELD OF THE INVENTION

This invention generally relates to the art of electrical connectors and, particularly, to an electrical connector having a molded plastic housing which is configured to reduce warpage.

BACKGROUND OF THE INVENTION

Electrical connectors generally include some form of dielectric housing mounting a plurality of conductive terminals which establish an interconnecting interface between a complementary mating connector, a printed circuit board, discrete electrical wires or any variety of other connecting devices. The terminals typically are mounted within terminal-receiving passages formed in the dielectric housing. Most often, the housing is molded of plastic material, and problems continue to be encountered because the housing is so fabricated.

More particularly, many electrical connectors having molded plastic housings which are considerably elongated. The elongated housings are highly susceptible to becoming bowed or warped, resulting in the terminals or at least the termination portions of the terminals not being in a straight line or in a given plane. The terminal portions become offset relative to each other and result in inferior or incomplete connections. Consequently, many connectors are molded with reinforcing or rigidifying flanges to prevent the housings from bowing. Unfortunately, when the housings become considerably elongated, these reinforcing flanges have the opposite affect of, themselves, causing warping in the molded plastic material due to uneven flow patterns during molding which, in turn, are caused by the uneven wall thicknesses created by the flanges. This invention is directed to solving these problems and the described dilemma presented in designing the molded plastic housings of elongated electrical connectors.

SUMMARY OF THE INVENTION

An object, therefore, of the invention is to provide a new and improved electrical connector of the character described.

In the exemplary embodiment of the invention, the connector includes a molded plastic housing having an elongated body portion defining a front mating face and a rear terminating face of the connector. A plurality of terminal-receiving passages are defined by wall means extending between the mating and terminating faces. The wall means are of generally uniform thickness between the faces to allow for even flow patterns of the plastic material during molding. A plurality of conductive terminals are mounted in the terminal-receiving passages.

As disclosed herein, the wall means include outside walls on opposite sides of the elongated body portion. The molded plastic housing includes enlarged end portions at opposite ends of the elongated body portion which is narrower than the end portions.

The connector is shown as a combination connector with the elongated body portion comprising a data section of the connector and the terminals comprising relatively smaller, closely spaced signal terminals. One of the enlarged end portions of the housing comprises a power section of the connector, and a plurality of relatively larger power terminals are mounted in the power section.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
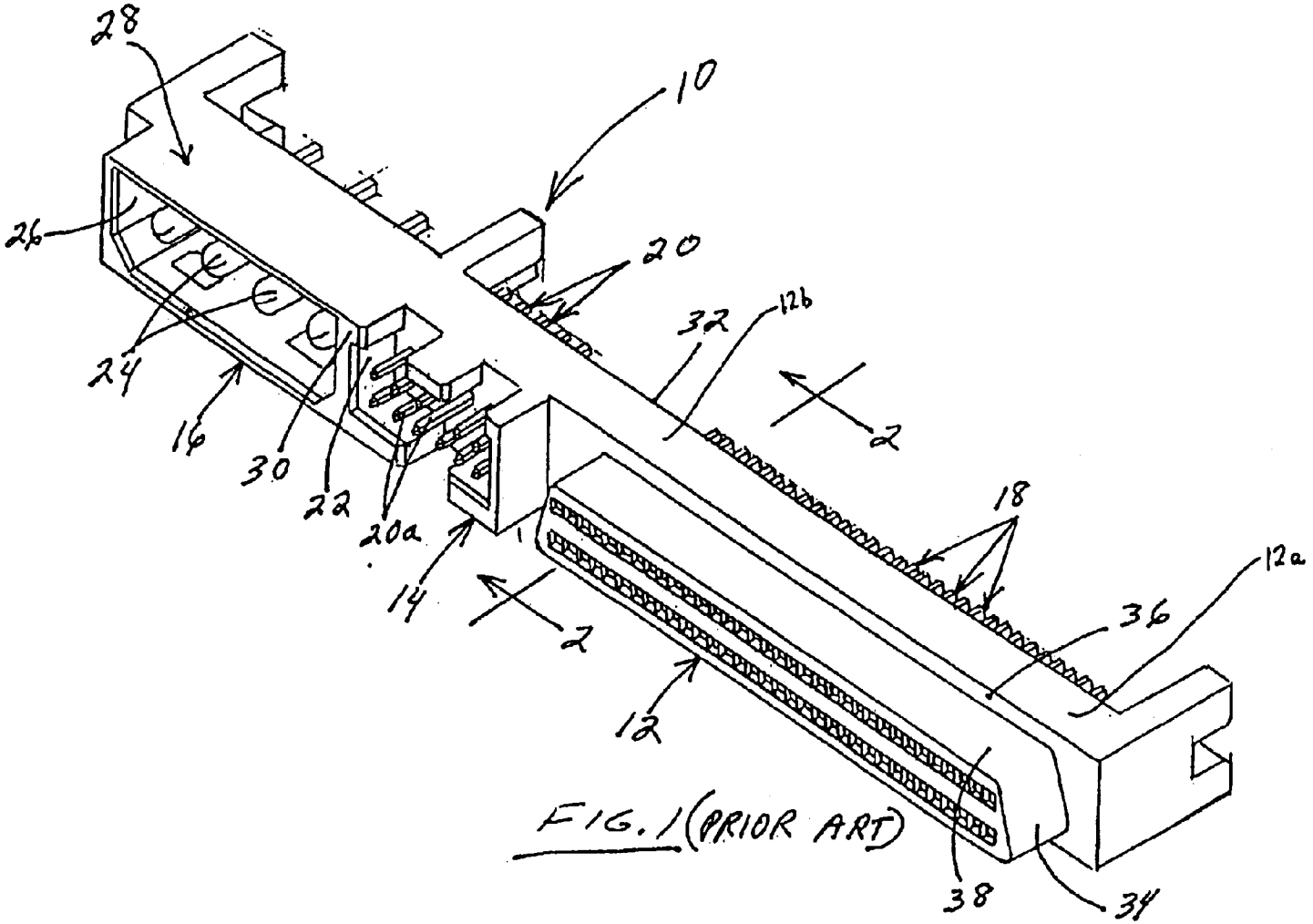
FIG. 1 (PRIOR ART)
FIG. 1 is a front perspective view of an elongated electrical connector according to the prior art.
Figure 2:
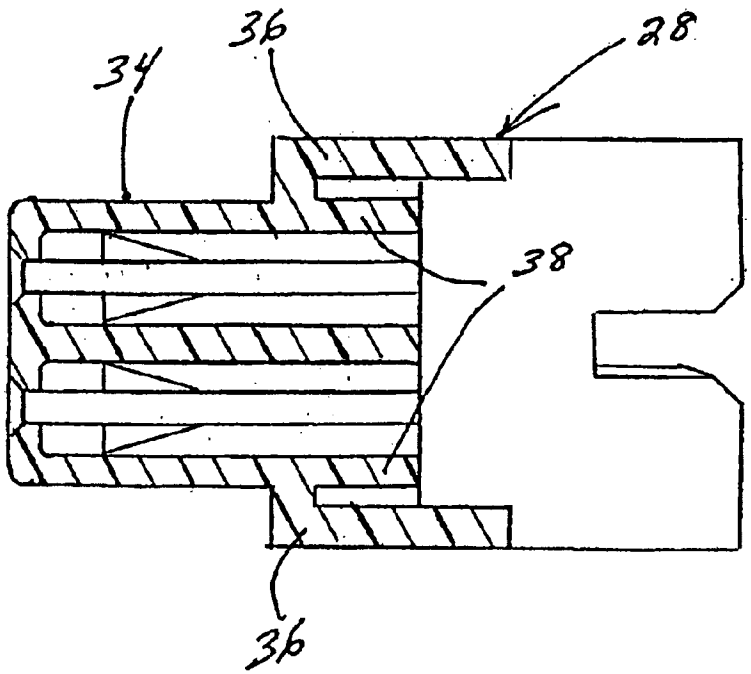
FIG. 2 (PRIOR ART)
FIG. 2 is a vertical section taken generally along line 2—2 of FIG. 1.

Referring to the drawings in greater detail, and first to FIGS. 1 and 2, an elongated electrical connector, generally designated 10, is shown according to the prior art. The connector is of the general type as might be found in U.S. Pat. No. 5,584,709, dated Dec. 17, 1997 and assigned to the assignee of the present invention. In particular, the connector of that patent and the connectors shown herein are combination ("combo") connectors which include three sections spaced lengthwise of the respective connector. The sections herein are generally designated 12, 14 and 16. Section 12 will be termed the data section of the connector and includes a plurality of signal terminals, generally designated 18. Section 14 will be termed the options section of the connector and include a plurality of pin terminals, generally designated 20, having pin portions 20*a* disposed in a center recessed area 22 for mating with terminals of a complementary connecting device or mating connector (not shown). Section 16 will be termed the power section of the connector and includes four large terminals 24 located in an end recessed area 26 for mating with the power terminals of the complementary mating connector.

Prior art connector 10 includes an elongated dielectric housing, generally designated 28, which, as best seen in FIG. 1, is of the same width W along the entire length of the connector. The housing defines a front mating face 30 and a rear terminating face 32. Data section 12 has a reduced-width, "D-shaped" projecting portion 34 for insertion into a complementary D-shaped receptacle of the complementary connecting device or mating connector.

Referring to FIG. 2 in conjunction with FIG. 1, it can be seen that the D-shaped projecting portion 34 is narrower than the width of housing 28 which runs the length of the connector. The uniform width of the housing along the entire length thereof is provided, in part, by flanges 36 which project outwardly from side walls 38 of the D-shaped receptacle. These flanges 36 provide reinforcement or rigidity for the elongated housing in the area of data section 12. However, it has been found that these flanges 36 in housing 28 of prior art connector 10 create uneven flow patterns of the molten plastic when housing 28 is molded. The uneven flow patterns are particularly prevalent at the junctures of side walls 38 and flanges 36 at opposite ends 12*a* and 12*b* of data section 12.

Figure 4:
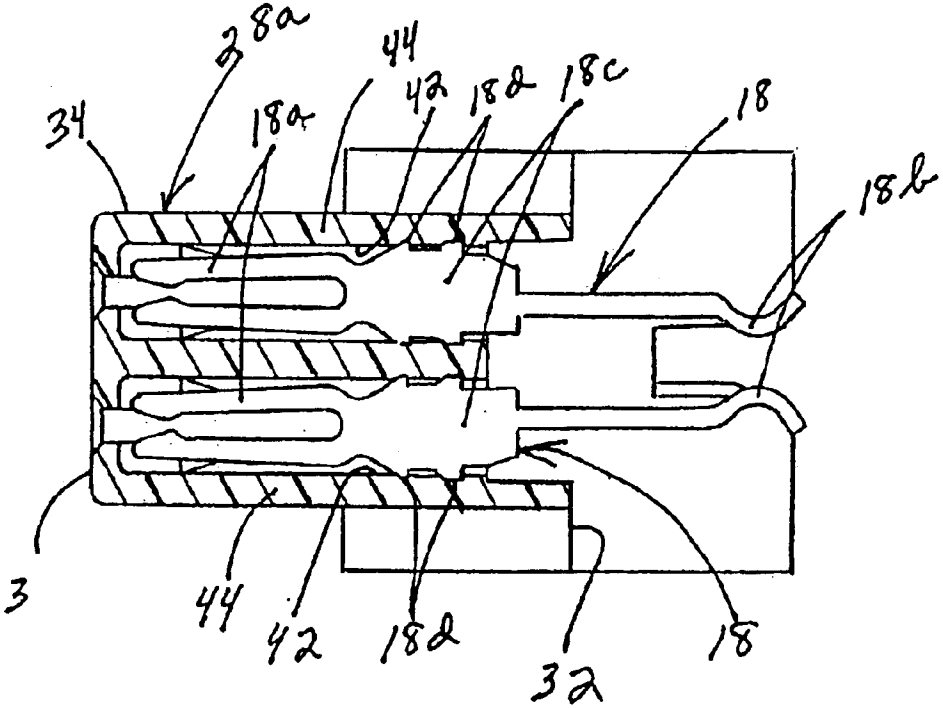
FIG. 4 is a vertical section taken generally along line 4—4 of FIG. 3.
Figure 3:
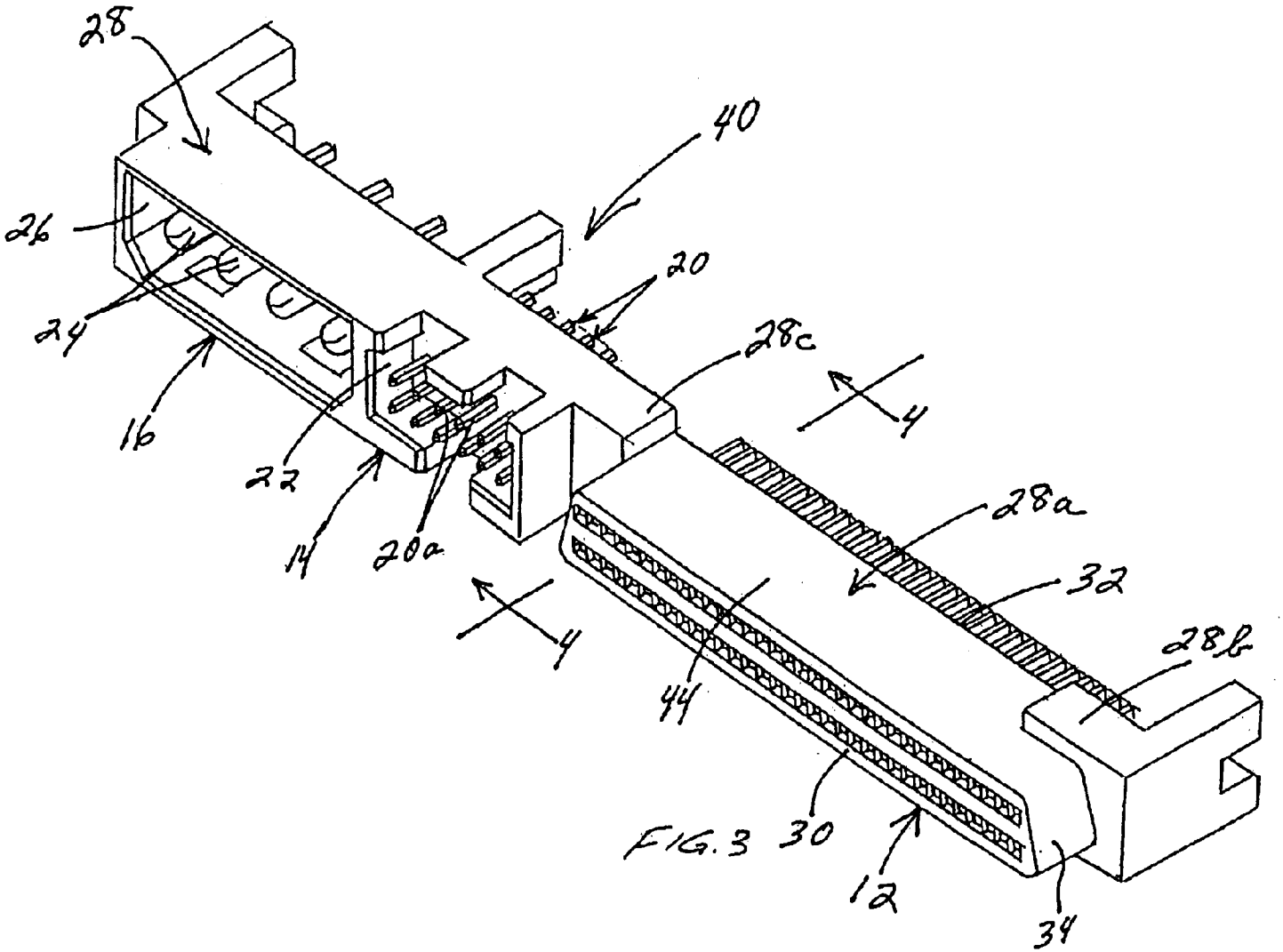
FIG. 3 is a front perspective view of an elongated electrical connector incorporating the concepts of the invention.

FIGS. 3 and 4 show a "combo" connector, generally designated 40, according to the invention. Like reference numerals have been applied in FIGS. 3 and 4 corresponding to like components described above in relation to prior art connector 10 in FIGS. 1 and 2. FIG. 4 shows that data terminals 18 include contact portions 18*a* projecting forwardly into the "D-shaped" portion 34 of data section 12. The terminals have terminating portions 18*b* extending rearwardly beyond terminating face 32 of the housing for engaging the contact pads on opposite sides of a printed circuit board inserted between the terminating portions 18*b*. The terminals have enlarged body portions 18*c* having teeth 18*d* which are press-fit into terminal-receiving passages 42.

As best understood in comparing FIG. 3 with the prior art of FIG. 1, the invention contemplates molding elongated data section 12 of housing 28 with an elongated central body portion, generally designated 28*a* (FIG. 3), which is of a uniform, but reduced width between mating face 30 and terminating face 32 of the data section. The reduced-width body portion 28*a* is located between enlarged or wider end portions 28*b* and 28*c*, with end portion 28*c* of the housing running all the way to the opposite end of the connector through power section 16.

The result of providing body portion 28*a* with a uniform width can best be seen in FIG. 4. The outsides of terminal-receiving passages 42 are bounded by side walls 44 that have uniform thicknesses between mating face 30 and terminating face 32. These uniform-thickness walls, in turn, allow for a very even flow pattern of the molten plastic material during the molding of the connector housing. The even flow pattern significantly reduces or minimizes warpage of the connector housing in the area of elongated body portion 28*a* of data section 12.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector comprising:

a housing having a front mating face and a rear terminating face;

a first end portion defined between said front mating face and said rear terminating face, said first end portion having a predetermined length and a consistent width along said predetermined length, said first end portion including a first recessed area accessible from said front mating face and a second recessed area accessible from said front mating face;

a second end portion having a predetermined length and a consistent width along said predetermined length, said width of said second end portion being generally equivalent to said width of said first end portion;

an elongated body portion provided between said first and second end portions and defined between said front mating face and said rear terminating face, said elongated body portion having a predetermined length and a consistent width along said predetermined length, said width of said elongated body portion being less than said widths of said first and second end portions, said elongated body portion including wall means extending between said front mating face and said rear terminating face for defining at least one terminal-receiving passage between said front mating face and said rear terminating face, said wall means being of generally uniform thickness between said front mating face and said rear terminating face along said predetermined length of said elongated body portion;

at least one conductive terminal mounted in said at least one terminal-receiving passage of said elongated body portion;

at least one pin terminal disposed in said second recessed area; and at least one terminal disposed in said first recessed area.

2. An electrical connector as defined in claim 1, wherein at least one terminal-receiving passage of said elongated body portion is a signal terminal.

3. An electrical connector as defined in claim 1, wherein said at least one terminal disposed in said first recessed area is a power terminal.

4. An electrical connector as defined in claim 1, wherein said width of said elongated body portion is defined by a dimension which is transverse to said at least one terminal-receiving passage, and wherein said width of said first and second end portions is defined by a dimension which is transverse to said at least one terminal-receiving passage.

5. An electrical connector as defined in claim 1, wherein said housing is made of plastic.

6. An electrical connector as defined in claim 1, wherein a plurality of terminal-receiving passages are defined in said elongated body portion by said wall means, each said terminal-receiving passage being configured such that only a single conductive terminal can be mounted therein.

* * * * *